United States Patent [19]

Cimino

[11] Patent Number: 5,000,482

[45] **Date of Patent: * Mar. 19, 1991**

[54] SKI LOCATING DEVICE UTILIZING A FOAM BALL

[76] Inventor: John J. Cimino, 342 Ridge Ave., #3, Evanston, Ill. 60202

[ * ] Notice: The portion of the term of this patent subsequent to Apr. 24, 2007 has been disclaimed.

[21] Appl. No.: 493,358

[22] Filed: Mar. 14, 1990

[51] Int. Cl.[5] ..... A63C 11/00

[52] U.S. Cl. ..... 280/809; 280/637; 116/209; 441/6

[58] Field of Search ..... 280/809, 637; 116/209, 116/210, DIG. 9, DIG. 10; 441/6, 7, 9, 23, 30, 68, 78, 80, 84

[56] References Cited

U.S. PATENT DOCUMENTS

| | | | |
|---|---|---|---|
| 421,686 | 2/1890 | Fagan et al. | 441/6 |
| 736,692 | 8/1903 | Condren | 441/6 |
| 1,633,484 | 6/1927 | Guidotti | 441/6 |
| 3,267,498 | 8/1966 | Pearson, Jr. | 441/6 |
| 3,397,887 | 8/1968 | Caplan | 116/DIG. 9 X |
| 3,470,845 | 10/1969 | Mignano | 441/23 X |
| 4,661,077 | 4/1987 | Griffith et al. | 441/84 |
| 4,919,452 | 4/1990 | Cimino | 280/809 |

FOREIGN PATENT DOCUMENTS

| | | | |
|---|---|---|---|
| 2031810 | 4/1980 | United Kingdom | 441/6 |

*Primary Examiner*—Charles A. Marmor
*Assistant Examiner*—Brian Johnson
*Attorney, Agent, or Firm*—Larson and Taylor

[57] ABSTRACT

A ski locator device is provided which comprises a tether having one end attached to the ski and the other attached to a compliant dome member in engagement with a portion of the outer surface of a brightly-colored foam ball. The foam ball is compacted and inserted into a pouch which is attached either to the skier's leg or to his boot. Upon detachment of the ski from the skier's foot, the foam ball is pulled through an elasticized opening in the pouch and can thus be readily seen, thereby assisting in locating the ski.

10 Claims, 1 Drawing Sheet

SKI LOCATING DEVICE UTILIZING A FOAM BALL

CROSS REFERENCE TO RELATED APPLICATIONS

This application is a continuation in-part of U.S. Ser. No. 07/299,320 filed on Mar. 23, 1989, now U.S. Pat. No. 4,919,452.

FIELD OF THE INVENTION

The present invention relates to a device for locating a detached ski in deep powder.

BACKGROUND ART

The modern ski binding is attached to the ski and is designed to release the skier's boot from the ski so as to prevent bodily injury to the skier. Unfortunately, when skiing in deep powdered snow, the ski is frequently lost because it will remain below the surface of the snow. Thus, the skier will have to dig in the snow, frequently exhausting himself in adverse weather conditions which may lead to health problems such as frost bite. Quite often, he will never find the ski because it was thrown too far from him, and, beside losing hundreds of dollars worth of ski equipment, he will have to walk down the mountain in deep snow and, thus, again expose himself to health hazards from fatigue or adverse weather conditions. This invention is designed to enable the skier to locate his ski quickly while still allowing the ski to completely detach from the skier's boot and thus prevent bodily harm.

Various devices have been designed to prevent the skier from losing his ski in deep powder. Patents of interest in this field, or in locating lost objects in general, include the following:

U.S. Pat. No. 4,535,322 issued Aug. 13, 1985, to Yeski discloses a ski alarm and locator that sounds an alarm when the ski becomes detached from the boot. The system relies on sound rather than sight. It requires complex electrical circuitry and a power source which would be much more expensive and may become faulty, unbeknownst to the skier. It does not offer the simple, straight-forward, and inexpensive means that my invention offers.

U.S. Pat. No. 4,685,697 issued Aug. 11, 1987, to Thorley discloses a retractable ski leash device. The leash is attached to the skier's boot on one end and is wound around a spool in a housing attached to the ski on the other end. This device does not permit complete detachment of the ski from the skier's boot, as does my invention, and thus may lead to serious bodily injury in a more serious ski accident, hurting either the skier wearing the device or an innocent bystander. Furthermore, the housing embodying the spool to which the tether is attached may become faulty in icy conditions or simply from wear and tear.

U.S. Pat. No. 4,063,753 issued Dec. 20, 1977 to Cordeiro discloses a runaway binding device which causes the ski to remain attached to the skier's ankle by means of a long tether after a fall. The device would be dangerous both to the skier and to innocent bystanders because the tether would pull the ski along with the skier during a serious accident.

U.S. Pat. No. 3,945,338 issued Mar. 23, 1976 to Correa discloses an inflatable balloon for locating lost aircraft.

U.S. Pat. No. 4,013,035 issued Mar. 22, 1976 discloses a balloon signal assembly embodying a means of automatically filling a balloon with a lighter than air gas for signalling purposes. This is not designed for snow skiing and would not apply here.

U.S. Pat. No. 3,764,154 discloses a safety ski binding which includes a rigid base plate member disposable between a sole member of a ski boot and a ski member. This would not provide for ski location after a fall.

U.S. Pat. No. 3,893,682 discloses a releasable ski binding having a self-restoring capability. This does not provide a means for locating a ski after a fall.

U.S. Pat. No. 4,203,614 discloses a ski binding employing a cable connected at one end to the skiing boot and at the other end to the ski. This does not permit for complete detachment of the ski from the skier.

German Patent No. 24 06 754 discloses a retractable line tethering a ski to a skier's boot. This does not provide for complete detachment of the ski from the skier.

German Patent No. 27 06 015 discloses a ski recovery device consisting of a belt which is attached to the ski boot or user at one end and fixed to the ski at the other end. This does not provide for complete detachment of the ski from the skier.

German Patent No. 26 24 501 discloses a strap having one end fastened to the heel housing of the ski boot via a coil spring. A snap hook on the other end is attached to an eye on the ski or ski bonding. This does not provide for complete detachment of the ski from the skier.

German Patent No. 29 30 502 discloses a rotatable spool fitted on the upper surface of the ski which carries a connecting line attached to the skier. The connecting line is made from a phosphorescent material and employs an optical or acoustic warning installation on the ski and coordinated with the moving of the spool.

SUMMARY OF THE INVENTION

In accordance with the invention disclosed in application U.S. Ser. No. 07/299,320, now U.S. Pat. No. 4,919,452, a ski locating device utilizing an expandable signal element, preferably a foam ball, is provided to enable a snow skier to locate his ski in deep powder snow after it has been completely detached from this boot. The fact that with my earlier invention, and with the present invention, the ski becomes completely detached from the skier is critical to safety because if the ski is left dangling from the skier's boot or ankle by means of a tether, the tether can cause the ski to injure the skier or an innocent bystander.

It is the object of this invention and my previous invention to enable the ski to be completely detached from the skier yet enable the skier to easily find his ski, particularly in deep powder. This is done by means of the expandable signal element, i.e., the foam ball, which is attached to the ski by means of a tether and which is brightly colored and large enough that it will remain above the level of the snow even after the ski is buried beneath the level of the snow. Because the ski is completely detached from the skier, it will not cause bodily injury. Furthermore, the skier can now more easily erect himself after falling because he is not tied to the ski by the tether.

Although the invention of application U.S. Ser. No. 07/299,320 now U.S. Pat. No. 4,919,452 is generally effective, there can be possible problems with the foam ball and tether. More specifically, where the foam used for the ball is relatively light and flimsy in order to enable compression thereof so as to fit into a pouch, the cord or other tether attached to the foam ball can pull out from the ball depending on the force exerted when the ski is detached thus defeating the purpose of the device. In accordance with an important feature of the present invention, the cord or tether is attached to means, other than or separate from the foam ball, for distributing the force exerted on the cord over a substantial area of the foam ball so as to prevent the cord from pulling away or out from the ball. This means preferably comprises a pliable or resilient dome fabricated of rubber, plastic or the like which is disposed over a part of the surface area of the ball and to which the free end of the cord is attached after passing through an aperture in through the center of the foam ball.

With both inventions, the foam ball is kept out of the way of the skier during skiing by being compressed neatly into a pouch which is attached to the skier's boot or to his ankle. In my previous application, an aperture is provided in the distal end of the pouch which is large enough to enable the foam ball to exit the pouch when the ski becomes detached from the skier during a fall. Although the pouch is disclosed in my earlier application as being zippered, other methods of closure can obviously be employed and according to a preferred embodiment of the present invention, the zippered opening is eliminated and a simple elasticized opening is provided e.g., an opening with elastic band extending around at least part of the edge thereof, so as to enable the ball to be readily inserted into the pouch and to be relatively easily pulled out therethrough from the pouch.

Other features and advantages of the invention will be set forth in, or apparent from, the following detailed description of preferred embodiments of the invention.

BRIEF DESCRIPTION OF THE DRAWINGS

This invention can be more readily understood by referring to the accompanying drawings wherein.

DETAILED DESCRIPTION OF A PREFERRED EMBODIMENT

Figure 1:
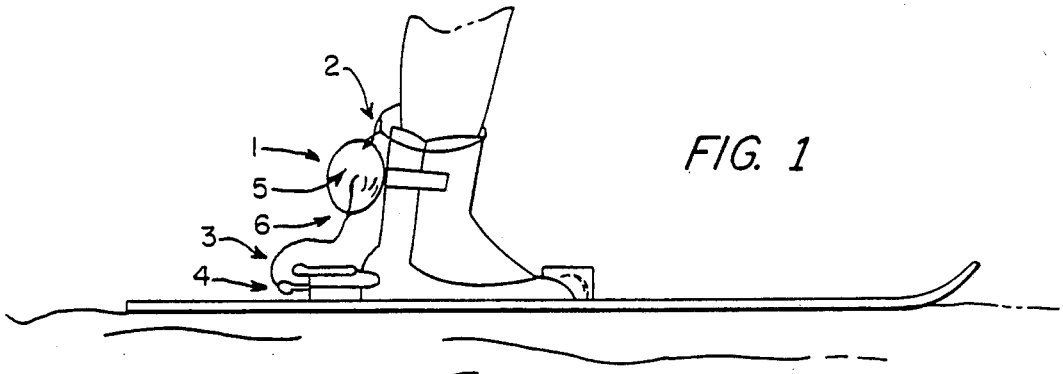
FIG. 1 is a side-elevational view of the ski locator device of the invention and shows what the ski locator device looks like while the skier is skiing.
Figure 2:
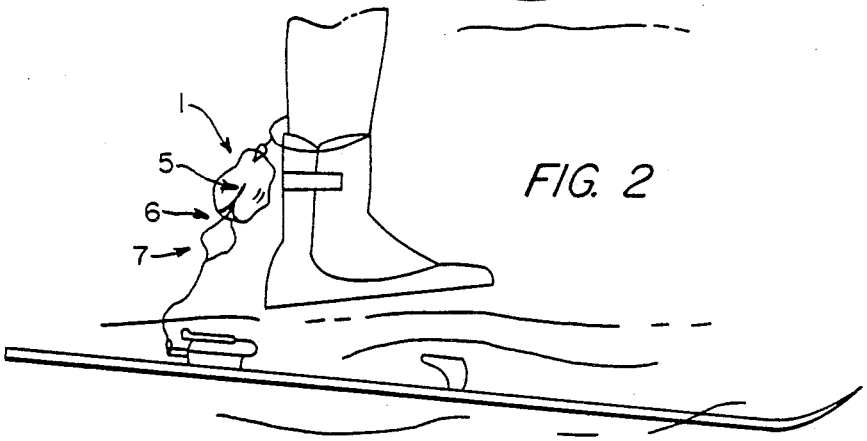
FIG. 2 is a view similar to FIG. 1 and shows a foam ball beginning to be pulled through an elasticized opening of a pouch as the skier's boot becomes detached from the binding on the ski during a fall.
Figure 3:
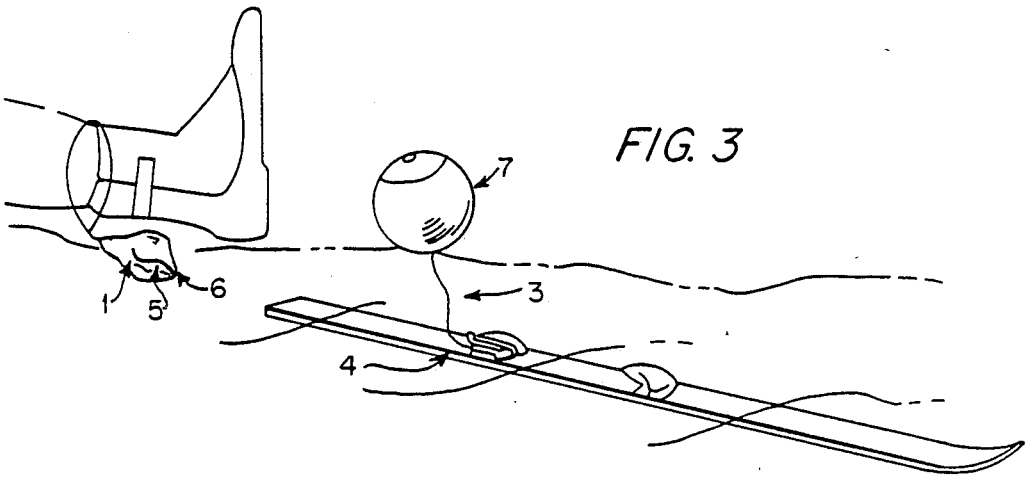
FIG. 3 is also a view similar to FIG. 1 and shows the foam ball now completely pulled out of the pouch. The skier has fallen, and the pouch remains attached to the skier. The foam ball remains with the ski and is attached to it via a tether. Although the ski is buried beneath the snow, the brightly colored foam ball remains above the level of the snow.
Figure 5:
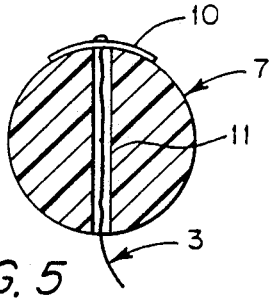
FIG. 5 is a cross-sectional view, to an enlarged scale, of the foam ball of FIG. 3.

FIG. 1 shows a pouch (1) completely enclosing a compressible signal element comprising a foam ball which is not shown in FIG. 1 but is denoted (7) in FIGS. 2, 3, and 5. An elasticized opening (5) in pouch (1) is closed in FIG. 1. The pouch (1) is attached by a tether (2) to the skier's ankle. This may be substituted for a clip which attaches over the top edge of the skier's boot. The tether (3) which is attached to the foam ball in FIG. 1 is seen as it exits from a distal end (6) of the opening (5) in pouch (1). This tether (3) is attached to the skier's binding by a ring (4). This arrangement can be changed to allow the tether (3) to be instead attached to the ski itself.

FIG. 2 shows the foam ball (7) as it begins to exit the distal end (6) of the opening (5). The elasticized opening (5) is shown partially closed at this time but will be fully opened substantially immediately. As illustrated, the skier's boot is released from the binding of the ski during the fall.

FIG. 3 shows the foam ball (7) now completely free from the pouch and located above the level of the snow while the ski is below the level of the snow (indicated in chain lines). The tether (3) keeps the foam ball (7) attached to the ski by the ring (4). The foam ball (7) has exited from the pouch (1) via the elasticized opening (5).

Figure 4:
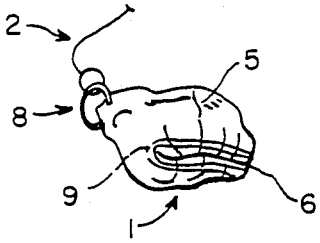
FIG. 4 is a more detailed perspective view, drawn to an enlarged scale, with the pouch now opened so that the foam ball can once again be neatly compressed into the pouch. The pouch would then be closed, and the tether attached to the foam ball would hang out of the pouch so that the tether can again pull the foam ball out when necessary.

FIG. 4 shows the pouch (1) with the elasticized opening (5) in a closed, empty state, i.e., with the foam ball (7) removed. As illustrated, an elastic band, indicated at (9), surrounds opening (5) and permits expansion thereof to enable refitting the foam ball (7) into the pouch (1). The elasticized opening (5) is such as to retain foam ball (7) in place within pouch (1) but to permit the ball (7) to be pulled out of the pouch (1) under the circumstances described above and to also permit the opening (5) to be expanded to enable foam ball (7) to be replaced in pouch (1). There is a ring (8) on the proximal end of the pouch to enable the tether (2) to attach to the pouch. This tether (2) then attaches to the skier's ankle as described above. The pouch may be made from a variety of material such as vinyl or leather.

FIG. 5 shows the foam ball (7) in more detail and as is shown in this figure here, and in FIG. 3, a pliable or resilient dome member (10) is connected at the free end of the tether or cord (3) and is in engagement with the upper or distal surface of foam ball (7). It should be understood that although dome member (10) is pliable this is not absolutely necessary. Ball (7) includes a central hole (11) extending diametrically therethrough through which the cord (3) passes and a knot (12) or the like at the end of cord (3) prevents the cord (3) from being pulled out of dome member (10). The arrangement including dome member (10) distributes any force exerted by cord (3) over the surface of the ball (7) and prevents the cord (3) from being pulled out from ball (7) such as might occur if cord (3) were directly connected to foam ball (7).

In an alternative embodiment, a protective sheath (not shown) can be provided which extends through the central hole (11) of foam ball (7) and which is attached to dome or disc member (10). This will permit the tether (3) to slide in and out of the foam ball (7) within this protective sheath and not wear on or tear the foam ball (7).

Although the present invention has been described relative to specific exemplary embodiments thereof, it will be understood by those skilled in the art that variations and modifications can be effected in these exemplary embodiments without departing from the scope and spirit of the invention.

What is claimed is:

1. A device for locating a ski after the ski has become separated from a skier wearing the ski, said device comprising:

a normally closed, openable pouch, including an exit opening therein, and means for attaching the pouch to a skier;

a signal element confined in a compressed state within said pouch and expandable to an expanded state upon release thereof from said pouch through said exit opening in said pouch, said signal element including a foam ball and a resilient dome member in engagement with a portion of the surface of said ball; and tether means, having a first end, which extends through said exit opening in said pouch and is attached to said dome member and a second end which is disposed outside of said pouch and which includes means for attaching the second end of the tether means to a ski worn by the skier, for, when the ski is separated from the skier, pulling the signal element out of said pouch through said exit opening so as to permit said signal element to expand to the expanded state thereof and thereby indicate the location of the ski.

2. A device for locating a ski according to claim 1, wherein said foam ball includes a central hole therein through which the first end of said tether means extends.

3. A device for locating a ski according to claim 1, wherein an exit opening in said pouch includes an openable closure means for permitting, when opened, the signal element to be inserted into the pouch and enclosed therein by closing the openable closure means.

4. A device for locating a ski according to claim 3, wherein openable closure means comprises an elasticized opening on said pouch.

5. A device for locating a ski according to claim 1, wherein said means for attaching the pouch to a skier comprises a ring.

6. A device for locating a ski after the ski has become separated from a skier wearing the ski, said device comprising:

a normally closed, openable pouch, including an elasticized exit opening therein and means for attaching the pouch to a skier;

a compressible signal element confined in a compressed state within said pouch and expandable to an expanded state upon release thereof from said pouch through said exit opening in said pouch; and tether means, having a first end, which extends through said exit opening in said pouch and is attached to said signal element and a second end which is disposed outside of said pouch and which includes means for attaching the second end of the tether means to a ski worn by the skier, for, when the ski is separated from the skier, pulling the signal element out of said pouch through said exit opening so as to permit said signal element to expand to the expanded state thereof and thereby indicate the location of the ski.

7. A device for locating a ski according to claim 6, wherein said signal element comprises a brightly colored foam ball.

8. A device for locating a ski according to claim 6, wherein said elasticized opening in said pouch includes an elastic band which at least partially surrounds said opening.

9. A device for locating a ski according to claim 6, wherein said means for attaching the pouch to a skier comprises a ring.

10. A device for locating a ski according to claim 6, wherein said signal element comprises a foam ball and a resilient dome member in engagement with a portion of the surface of said ball.

* * * * *